United States Patent [19]

Charles et al.

[11] 3,967,573

[45] July 6, 1976

[54] APPARATUS FOR STABILIZING UNDERWATER DEVICES

[75] Inventors: Joel M. Charles, La Valette; Maurice Roger Fourtier, Cros-de-Cagnes, both of France

[73] Assignee: Etat Francais represente par le Delegue Ministeriel pour l'Armement, France

[22] Filed: July 18, 1975

[21] Appl. No.: 597,078

[30] Foreign Application Priority Data

Aug. 1, 1974 France ..... 74.26704

[52] U.S. Cl. ..... 115/6; 114/235 B; 115/35

[51] Int. Cl.[2] ..... B63B 21/56

[58] Field of Search ..... 114/16 R, 21 R, 21 W, 114/23–25, 235 B, 236–237; 115/6, 6.1, 7, 35, 34 R; 340/3 T, 4 R

[56] References Cited

UNITED STATES PATENTS

| | | | |
|---|---|---|---|
| 1,326,760 | 12/1919 | Macinante | 115/35 |
| 1,331,819 | 2/1920 | Matheny | 115/35 |

*Primary Examiner*—Trygve M. Blix
*Assistant Examiner*—Jesus D. Sòtelo
*Attorney, Agent, or Firm*—Stevens, Davis, Miller & Mosher

[57] ABSTRACT

An apparatus provided on a self-propelled underwater device connected to its base by a cable. The apparatus comprises an auxiliary propeller disposed at the rear of the device in a support to which is secured the connecting cable and which is connected to the device by a universal joint; the apparatus also includes elements for measuring the forces which the universal joint applies to the device to automatically act on the propeller to offset these forces.

9 Claims, 5 Drawing Figures

FIG. 1
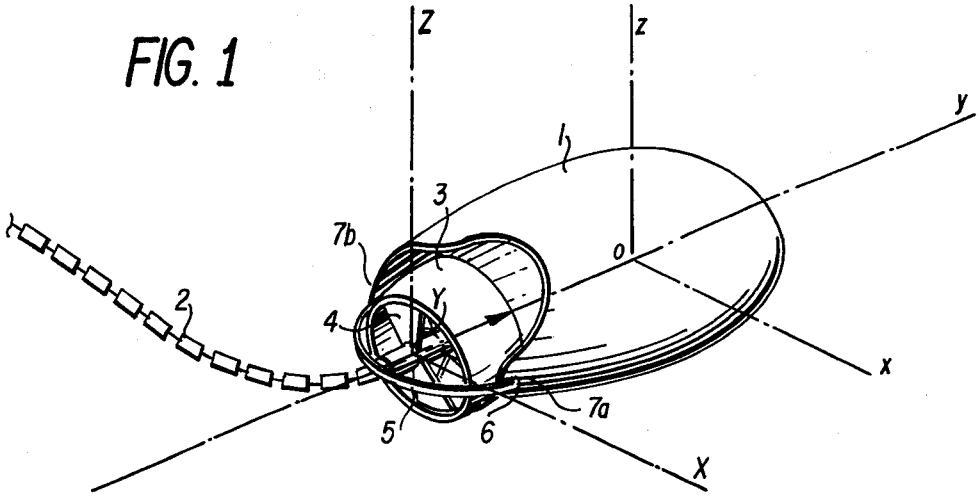
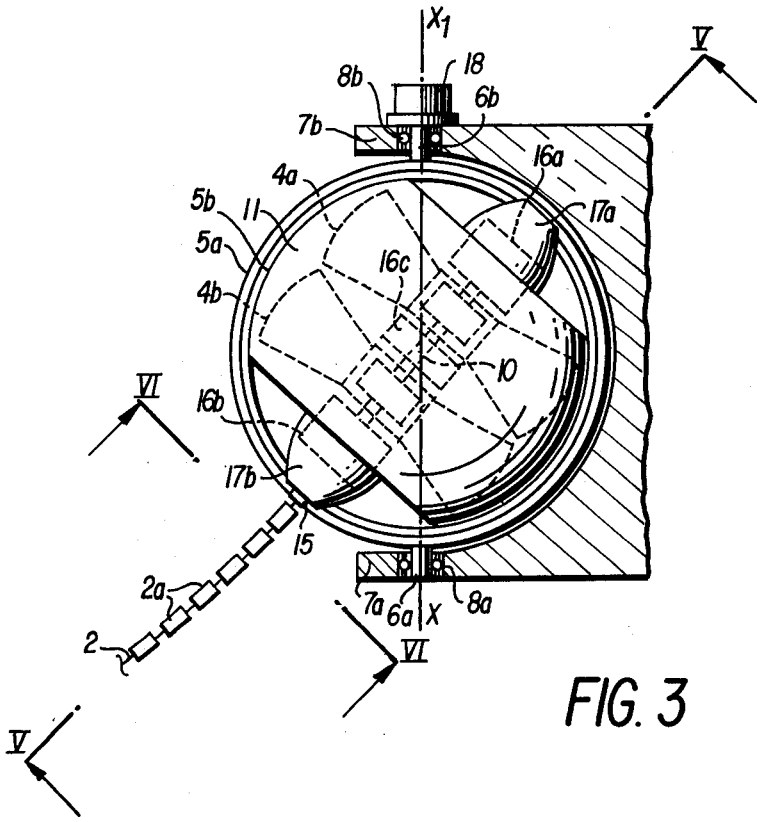
FIG. 3

APPARATUS FOR STABILIZING UNDERWATER DEVICES

BACKGROUND OF THE INVENTION

The present invention relates to a stabilizing apparatus provided on a self-propelled underwater device connected to its base by a cable, which apparatus is intended to prevent the cable from applying to the device stray forces due to hydrodynamic thrust on the cable.

The technical field with which the invention is concerned is that of the construction of self-propelled underwater devices, manned or otherwise, connected to their control base (surface craft, submarine, fixed underwater structure or shore installation) by a cable, known as a leash, which supplies energy to the device and/or is used to transmit signals between the device and said control base.

Movements of the device and of the water currents apply hydrodynamic thrust to the connecting cable which transmits the thrust to the device in the form of drag or torque, and this complicates the piloting of the device.

These parasitic forces are at present dealt with by equipping the device with guide propellers which are started up to correct the direction of travel of the device. This method calls for the use of costly supplementary guiding equipment and does not enable the hydrodynamic forces to be completely offset. Thus the paths of travel are irregular.

The object of the present invention is to eliminate automatically all the parasitic forces transmitted to the device through the connecting cable.

SUMMARY OF THE INVENTION

This object is achieved by means of an apparatus which comprises an auxiliary propeller located to the rear of the device in a support to which is secured the connecting cable and which is connected to the device by a universal joint; the apparatus also includes means for measuring the forces which the universal joint applies to the device to automatically act on the propeller so as to offset these forces.

The auxiliary propeller preferably consists of two screws rotating in opposite directions to each other and applying zero axial torque by differential counterbalancing. In a preferred arrangement it is disposed along the diameter of a first ring which pivots within a second concentric ring; the latter is mounted to rotate about one of its diameters on two diametrically opposed pivots which turn in a mounting in the form of a doublepronged fork formed by the rear end of the device. The two pivots are preferably located in a plane slightly offset from the plane of the rings.

The means for measuring the forces applied by the universal joint to the device preferably consist of strain gauges placed on the bearing surfaces of the journals of the pivots for rotating the universal joint in said mounting.

The screws are preferably variable-pitch screws, and the pitch is automatically varied so that the sum of the signals supplied by the strain gauges remains zero.

The invention results in a novel product constituted by a self-driven underwater device equipped with a connecting cable, which device is not subjected to any force or to any torque through the connecting cable.

The cable is in fact secured to a support which, because of the presence of the universal joint, is free to take up any position about two axes which are at right angles to each other and which are initially at right angles to the longitudinal axis of the device. The hydrodynamic forces on the cable, which would be converted into torque about these two axes, cause rotation of the auxiliary propeller and of its support in relation to the device, and are not transmitted to the device.

The strain gauges placed on the bearing surfaces of the journals of the pivots of the universal joint detect the occurrence of any force at this locality. The signals produced in these strain gauges are used in a regulating chain of known type to act automatically on the propeller either for causing the pitch of the screws to be varied if the screws are of the variable-pitch type, or for causing their speed of rotation to be varied in the direction for offsetting the sum of the signals and therefore the forces transmitted to the device by the universal joint.

The piloting of the device, either from within if the device is manned, or from a distance, becomes considerably easier, and in particular, it becomes possible to keep the device on a regular course.

BRIEF DESCRIPTION OF THE DRAWING

FIG. 1 is a general perspective view of a device equipped with an apparatus in accordance with the invention;

FIG. 3 is a plan view of the apparatus of the invention;

DESCRIPTION OF A PREFERRED EMBODIMENT

Figure 2:
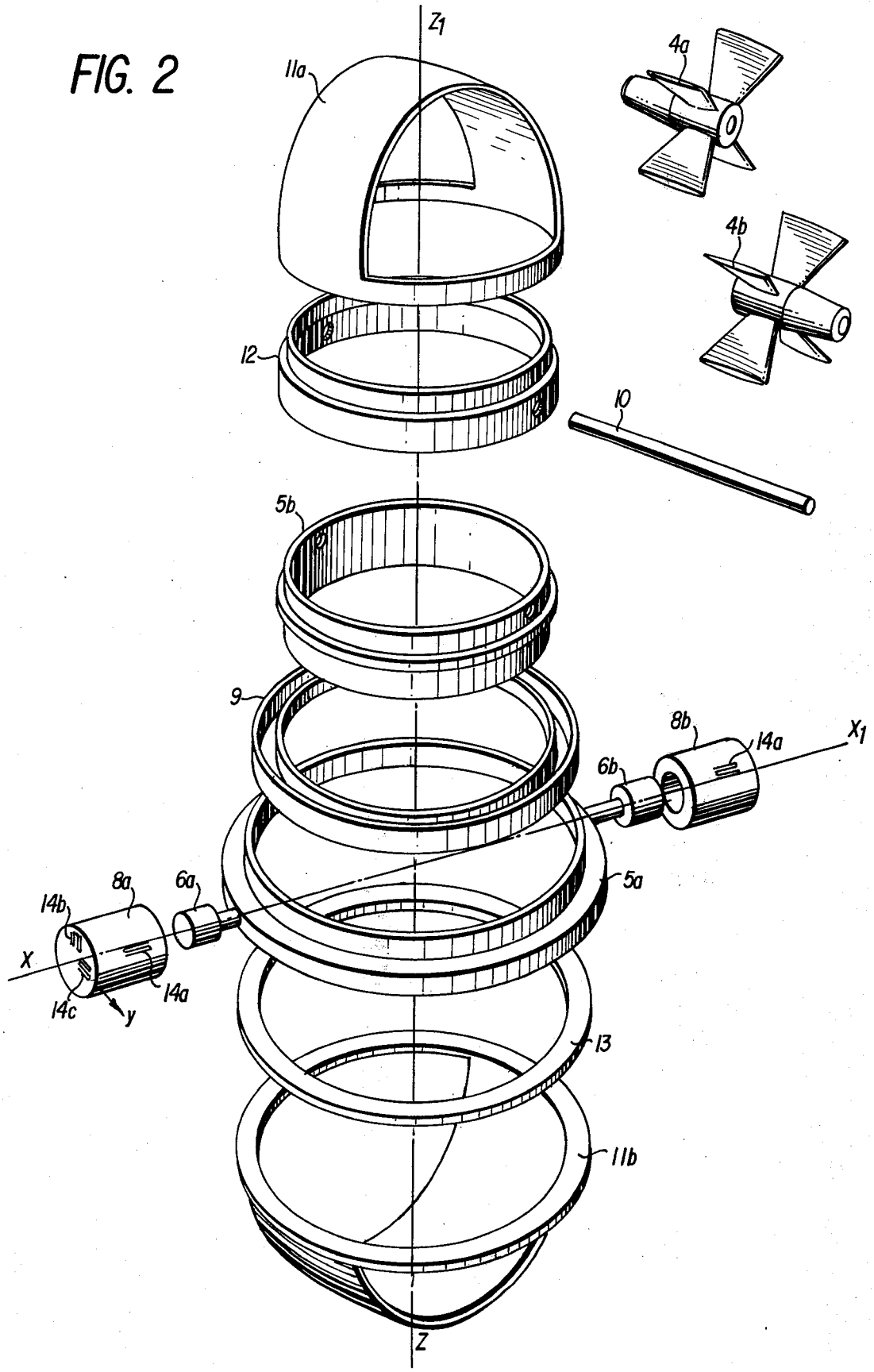
FIG. 2 is an exploded view of the apparatus of the invention.

FIG. 1 shows an underwater device 1 equipped with a cable 2 connecting it to its control base. The device 1 is self-propelled. The cable 2 is used, for example, for supplying electrical energy or for passing signals between the control base and the device. Because of the speed of displacement of the device and of water currents, the cable 2 is subjected to hydrodynamic thrust which is normally transmitted to the device, thus altering its course.

According to the invention, the device 1 is equipped with an apparatus 3 intended to prevent the cable 2 from applying force or torque to the device 1. The longitudinal axis oy of the device and two axes ox and oz at right angles thereto are shown in FIG. 1.

The apparatus 3 consists of a variable-direction auxiliary propeller 4 shown with a system of connected coordinates ΩXYZ. Like the propellers of torpedoes, this propeller is formed, for example, by two screws turning in opposite directions and driven through a differential or by a motor having two rotors turning in opposite directions. The propeller 4 is connected to the device 1 by a universal joint, the two pivotal axes of which are the axis $XX_1$, at right angles to the plane zoy, and the axis $ZZ_1$ contained in the plane zoy.

The propeller 4 is mounted at the rear of the device 1 in a support 5 formed by two concentric rings pivoting relative to each other about the axis ΩZ at right angles to the plane of the two rings and located in the plane yoz. The outer ring is mounted to pivot about the axis ΩX by means of two diametrically opposed pivots 6 which turn in a mounting 7.

FIGS. 2–5 show the detailed construction of the invention. In particular, the apparatus for mounting propeller 4 comprises an outer equatorial ring 5*a* having two diametrically opposed pivots 6*a* and 6*b* which turn in bearings 8*a* and 8*b* carried by the two arms 7*a* and 7*b* of a fork formed by the rear end of the device 1. The equatorial ring 5a forms the outer race of a ballbearing unit 9, the inner race of which is formed by the ring 5*b*. A central tube 10 is disposed on a diameter of the ring 5*b*. Tube 10 acts as a shaft for the two screws 4*a* and 4*b* which rotate in opposite directions and which are driven by a motor reduction gear system (not illustrated).

The apparatus is completed by a housing formed by an upper shell 11*a* and a lower shell 11*b* secured to the inner ring 5*b* by upper and lower rings 12 and 13, respectively. The arrangement formed by the housing, the propeller and the inner ring 5*b* thus pivot in unison about the axis $ZZ_1$ relative to the outer ring 5*a* which pivots about the axis $XX_1$ in relation to the body of the device.

FIG. 2 shows strain gauges 14*a*, 14*b* and 14*c* placed on each of the bearings 8*a* and 8*b* and arranged in three directions, *ox*, *oy* and *oz*, respectively, which are at right angles to each other. These gauges provide electrical signals porportional to the forces transmitted to the device by the bearings. The outputs of the strain gauges are coupled to appropriate circuits for deriving a control signal based on a comparison of predetermined strain gauge output combinations.

FIG. 3 is a rear view of the device 1. This view shows the mounting 7 formed by the two arms 7*a* and 7*b* and supporting the bearings 8*a* and 8*b*. The pivots 6*a* and 6*b* solidly connected to the outer equatorial ring 5*a* are mounted to pivot in bearings 8*a* and 8*b*. This Figure also shows the inner equatorial ring 5*b* supporting the hollow shaft 10. The connecting cable 2, equipped with floats 2*a*, is secured at 15 to one end of the shaft 10. The electrical conductors extend into the interior of the device either by way of a flexible portion, which does not interfere with rotation, or by way of a rotary contact. FIG. 3 also shows the two screws 4*a* and 4*b* of the propeller which rotate in opposite directions and are driven by motor reduction gears 16*a* and 16*b* interconnected by a differential gear 16*c*. The assembly consisting of the screws and the drive units is enclosed in the housing 11 which has two extensions 17*a* and 17*b* enclosing the ends of the shaft 10.

The arm 7*b* carries a servo-motor 18 which drives the pivot 6*b*. This servo-motor is automatically controlled by a signal provided by a torque pick-up which measures the torque along the axis $XX_1$ transmitted by the support 5*a* to the body of the device. The signal acts on the servo-motor 18 to cause the movable assembly to turn about the axis $XX_1$ in the direction for offsetting the torque. For example, the signal which controls the servo-motor 18 is equal to the difference between the signals provided by the two strain gauges 14*a* placed on the bearings 8*a* and 8*b*. This servo-motor 18 may be dispensed with, since in practice the hydrodynamic thrust of the cable on the movable assembly causes the latter to turn about the axis $XX_1$ in the direction for offsetting the torque along said axis.

Figure 4:
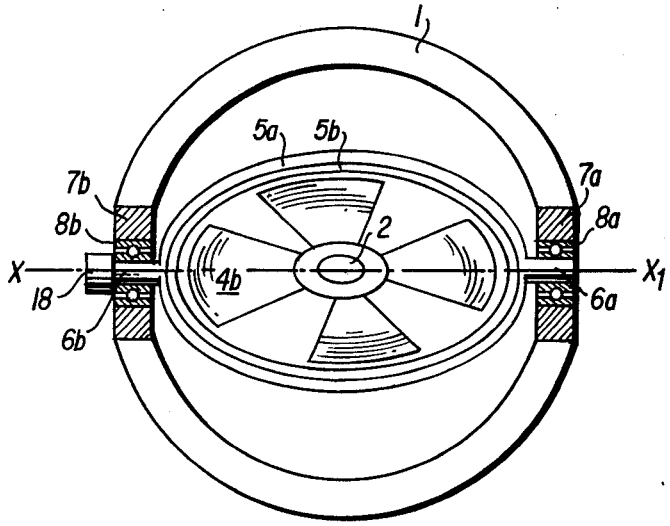
FIG. 4 is a rear view taken along line IV—IV in FIG. 3.

The apparatus may comprise a second servo-motor for causing the equatorial ring 5*b* to turn automatically in the ring 5*a* and controlled in a similar manner to that of the first servo-motor 18. This second servo-motor is not shown in the drawings and, like the first servo-motor 18, it can be dispensed with, since the forces applied by the cable are sufficient to cause this turning movement. FIG. 4 shows the rings 5*a* and 5*b* in an inclined position following a turning movement about the axis $XX_1$.

Figure 5:
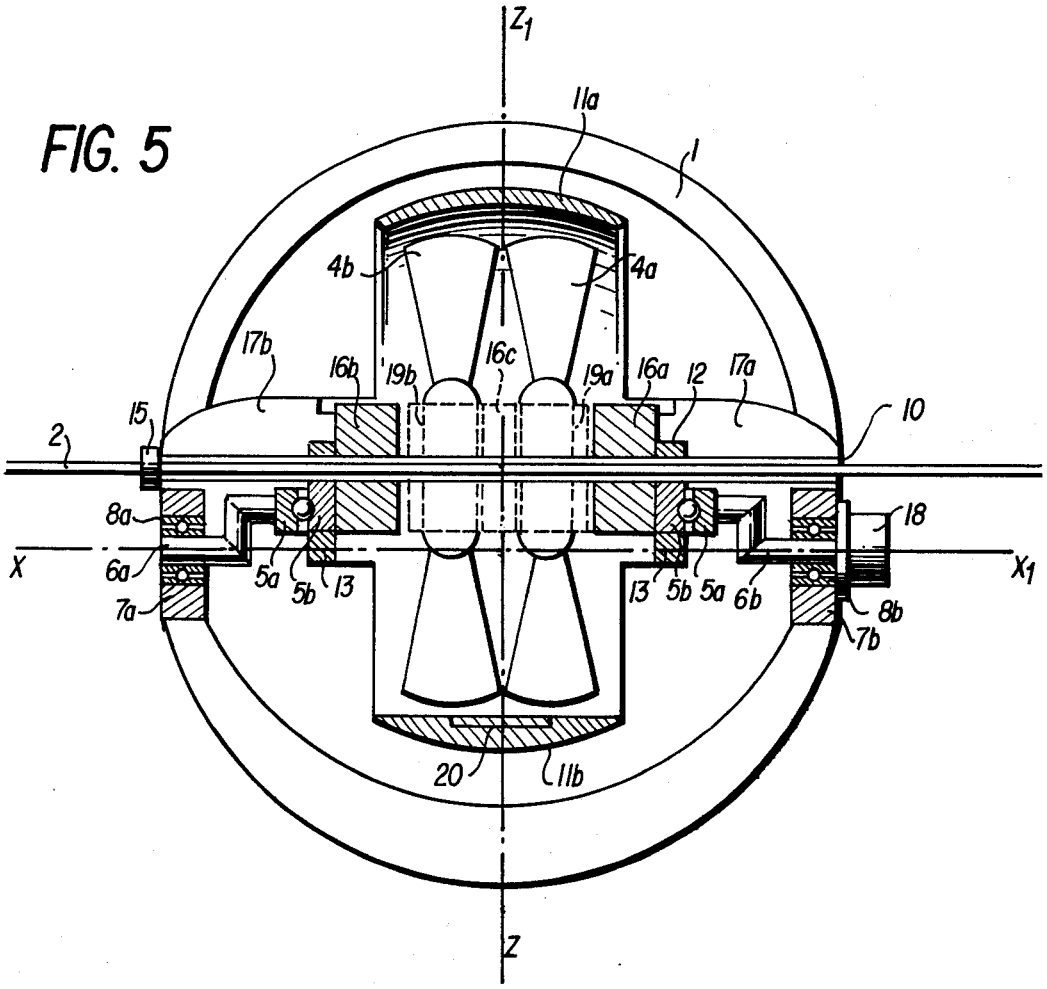
FIG. 5 is a longitudinal section taken along line V—V in FIG. 3.

FIG. 5 shows, in section, the outer equatorial ring 5*a* and the inner equatorial ring 5*b* forming the two races of a ball-bearing unit. The outer ring 5*a* is mounted to pivot in the bearings 8*a* and 8*b* carried by the two arms 7*a* and 7*b* of the mounting at the rear of the device. The pivots 6*a* and 6*b* are located at the end of two arms which are angled downwardly so that they are located at a level slightly lower than that of the top of the equatorial ring 5*b*, and so that the central tube 10 and the cable 2 are able to turn freely over the entire periphery.

FIG. 5 also shows the screws 4*a* and 4*b* which rotate in opposite directions and the drive units 16*a* and 16*b*, together with the differential gear 16c through which they are powered. The screws are, for example, variable-pitch screws and the mechanisms 19*a* and 19*b* for changing the pitch are shown diagrammatically.

These mechanisms are automatically controlled by signals provided by pick-ups, for example, by the sum of the signals provided by the strain gauges 14*a*, 14*b* and 14*c* placed on the support surfaces of the bearings 8*a* and 8*b*. The automatic action on the pitch-changing mechanisms is so selected that the thrust of the propeller acts in the direction for offsetting the sum of the signals provided by the strain gauges, said action therefore offsetting the pull of the cable on the device.

To balance the movable assembly, a counterweight 20 is secured to the housing 11*b*.

It is, of course, possible, within the scope of the invention, to replace various of the elements forming the arrangements that have been described by elements having a similar function and well known to the person skilled in the art.

What is claimed is:

1. Apparatus for stabilizing a self-propelled underwater device connected to a control base by a control cable, comprising:

a support located at the rear portion of said underwater device and including a universal joint to which said cable is coupled;

an auxiliary propeller mounted on said universal joint for movement in two orthogonal directions;

means for measuring forces applied to said underwater device by said universal joint; and means coupled to said measuring means for adjusting said auxiliary propeller to offset said forces applied by said universal joint.

2. The apparatus according to claim 1, wherein said propeller comprises two screws rotating in opposite directions to each other.

3. The apparatus according to claim 2, wherein said oppositely rotating screws are interconnected by a differential gear.

4. The apparatus according to claim 2, wherein: said rear portion of said underwater device has the shape of a two-pronged fork; said support further comprises a pair of diametrically opposite pivots mounted in bearings carried by respective arms of said fork-shaped rear portion; and said universal joint comprises a first ring mounted for free rotation within a second concentric ring, said propeller being disposed along a diameter of said first ring and said second ring being coupled to said pivot for rotation about one of its diameters.

5. The apparatus according to claim 4, wherein said two pivots are disposed in a plane slightly offset from the plane of said rings.

6. The apparatus according to claim 4, wherein the means for measuring the forces applied to the device by the universal joint comprise strain gauges placed on the supporting surfaces of said bearings.

7. The apparatus according to claim 6, wherein each bearing carries on its outer faces three strain gauges placed in three directions at right angles to each other.

8. The apparatus according to claim 2, wherein said screws are variable-pitch screws, and further comprising means to automatically vary the pitch of said screws to reduce the sum of the signals furnished by the strain gauges to zero.

9. The apparatus according to claim 2, wherein the screws of said auxiliary propeller are mounted on a hollow driving shaft, and said connecting cable is secured to one end of said shaft.

* * * * *